US007434329B2

(12) United States Patent
Walda

(10) Patent No.: US 7,434,329 B2
(45) Date of Patent: Oct. 14, 2008

(54) MOUNTING CLIPS FOR SIDING BOARDS

(75) Inventor: Michael E. Walda, Harbor Springs, MI (US)

(73) Assignee: Bear Cub Enterprises, LLC, Harbor Springs, MI (US)

( * ) Notice: Subject to any disclaimer, the term of this patent is extended or adjusted under 35 U.S.C. 154(b) by 435 days.

(21) Appl. No.: 11/138,988

(22) Filed: May 26, 2005

(65) Prior Publication Data

US 2005/0262792 A1 Dec. 1, 2005

Related U.S. Application Data

(60) Provisional application No. 60/575,077, filed on May 27, 2004.

(51) Int. Cl.
*G01D 21/00* (2006.01)

(52) U.S. Cl. ..... 33/649; 52/98; 52/127.5; 52/794.1; 52/DIG. 1

(58) Field of Classification Search ..... 52/98, 52/100, 520, 747.11, 748.1, 748.11, 285.3, 52/127.7, 749.1, 749.11, DIG. 1, 127.5; 33/646, 647; 81/45
See application file for complete search history.

(56) References Cited

U.S. PATENT DOCUMENTS

| | | | | | |
|---|---|---|---|---|---|
| 368,574 | A | | 8/1887 | Eby | |
| 767,589 | A | * | 8/1904 | Moore | 248/201 |
| 2,511,083 | A | * | 6/1950 | Small | 52/547 |
| 3,222,831 | A | * | 12/1965 | Pritchard | 52/99 |
| 3,528,176 | A | * | 9/1970 | Lee et al. | 433/73 |
| 3,605,357 | A | * | 9/1971 | Stegmeier | 52/98 |
| 3,738,076 | A | * | 6/1973 | Kessler | 52/547 |
| 3,818,668 | A | * | 6/1974 | Charniga | 52/547 |
| 4,159,029 | A | | 6/1979 | Matthews | |
| 4,164,346 | A | | 8/1979 | Sickler | |
| 4,272,576 | A | * | 6/1981 | Britson | 428/100 |
| 4,314,429 | A | * | 2/1982 | Casteel et al. | 52/127.2 |
| 4,432,181 | A | * | 2/1984 | Funaki | 52/459 |
| 4,698,942 | A | * | 10/1987 | Swartz | 52/99 |
| 4,899,459 | A | | 2/1990 | Taggart | |
| D318,608 | S | * | 7/1991 | Schenker | D8/382 |
| D322,361 | S | * | 12/1991 | Goodman et al. | D6/323 |
| D342,889 | S | * | 1/1994 | Adams | D8/367 |
| 5,408,757 | A | | 4/1995 | Lenz | |
| 5,465,499 | A | | 11/1995 | LaPlante | |
| 5,522,149 | A | | 6/1996 | Meyer | |

(Continued)

*Primary Examiner*—Robert Canfield
*Assistant Examiner*—Brent W Herring
(74) *Attorney, Agent, or Firm*—Reising Ethington Barnes Kisselle, P.C.

(57) ABSTRACT

A mounting clip is designed to assist positioning and mounting of a first siding board to a wall overlapping a portion of a second siding board. The mounting clip includes a hanger which hangs the mounting clip on the second siding board. The mounting clip also includes a shelf. The shelf positions the first siding board such that the first siding board overlaps the second siding board. The mounting clip allows a single installer to accurately and efficiently install siding boards. The base of the mounting clips can be used as a guide to identify the portion of the siding board that can be nailed to the wall because the clip identifies the area that is going to be covered by the next siding board. An air gap between the wall and the siding boards is created by the mounting clip and prevents moisture from being trapped therebetween.

11 Claims, 4 Drawing Sheets

U.S. PATENT DOCUMENTS 5,564,245 A * 10/1996 Rademacher ..... 52/520
6,434,853 B2 8/2002 Pyburn
6,494,016 B1 * 12/2002 Bankson ..... 52/749.1
6,684,521 B2 2/2004 Rempe
6,886,796 B1 * 5/2005 Elander ..... 248/339
7,185,433 B2 3/2007 Miller
7,185,443 B2 * 3/2007 Penhale ..... 33/649
2001/0034952 A1 11/2001 Mansfield
2002/0174618 A1 * 11/2002 Carroll ..... 52/520
2004/0074188 A1 * 4/2004 Beck et al. ..... 52/522
2006/0272258 A1 * 12/2006 Pollock ..... 52/543
2007/0234674 A1 * 10/2007 Hadlum ..... 52/520

* cited by examiner

MOUNTING CLIPS FOR SIDING BOARDS

RELATED APPLICATIONS

This patent application claims priority to U.S. Provisional Patent Application having Ser. No. 60/575,077, filed May 27, 2004.

BACKGROUND ART

1. Field of the Invention

The invention relates to devices used to facilitate the construction of buildings. More specifically, the invention relates to clips used to facilitate the positioning and mounting of siding boards of walls of a building.

2. Description of the Related Art

The task of affixing siding to a wall of a building is a labor intensive task. Typically a crew of three people is required to efficiently cut, position and secure the siding to the wall. A three person crew is required to allow one person to cut the siding and the other two to stand on either side of a piece of siding while it is being positioned and secured. When one end is secured, the other is pivoted about the securing point to ensure the piece of siding is level before the second end is secured. Following that, the siding is secured intermittently therealong. This is undoubtedly a long and labor intensive procedure.

U.S. Pat. No. 4,164,346, issued to Sickler on Aug. 14, 1979, discloses a lap siding tool (siding as discussed herein shall include siding fabricated from any material, including cement, wood, and the like.) The lap siding tool is generally U-shaped and extends behind a piece of siding to position a piece of siding with respect to another piece of siding. Once the siding is secured in place, the tools are removed and reused. The design of the lap siding tool in this reference is deficient in many regards. First, these tools must be reused, due to their expense in fabrication. Second, there is no way to secure the lap siding tool to a piece of siding. These tools would easily fall off if there was a strong wind or the tools were accidentally bumped once in place. Third, the tools must be removed in a manner which would delay the continued construction of the siding along the wall.

SUMMARY OF THE INVENTION

A mounting clip is designed to assist the positioning and mounting of a first siding board to a wall overlapping a portion of a second siding board. The mounting clip includes a base extending between a top end and a bottom. The mounting clip also includes a hanger which is fixedly secured to the top end of the base. The hanger hangs the mounting clip on the second siding board. The mounting clip also includes a shelf fixedly secured to the bottom end of the base. The shelf positions the first siding board such that the portion of the first siding board overlaps the second siding board for positioning and mounting thereof.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
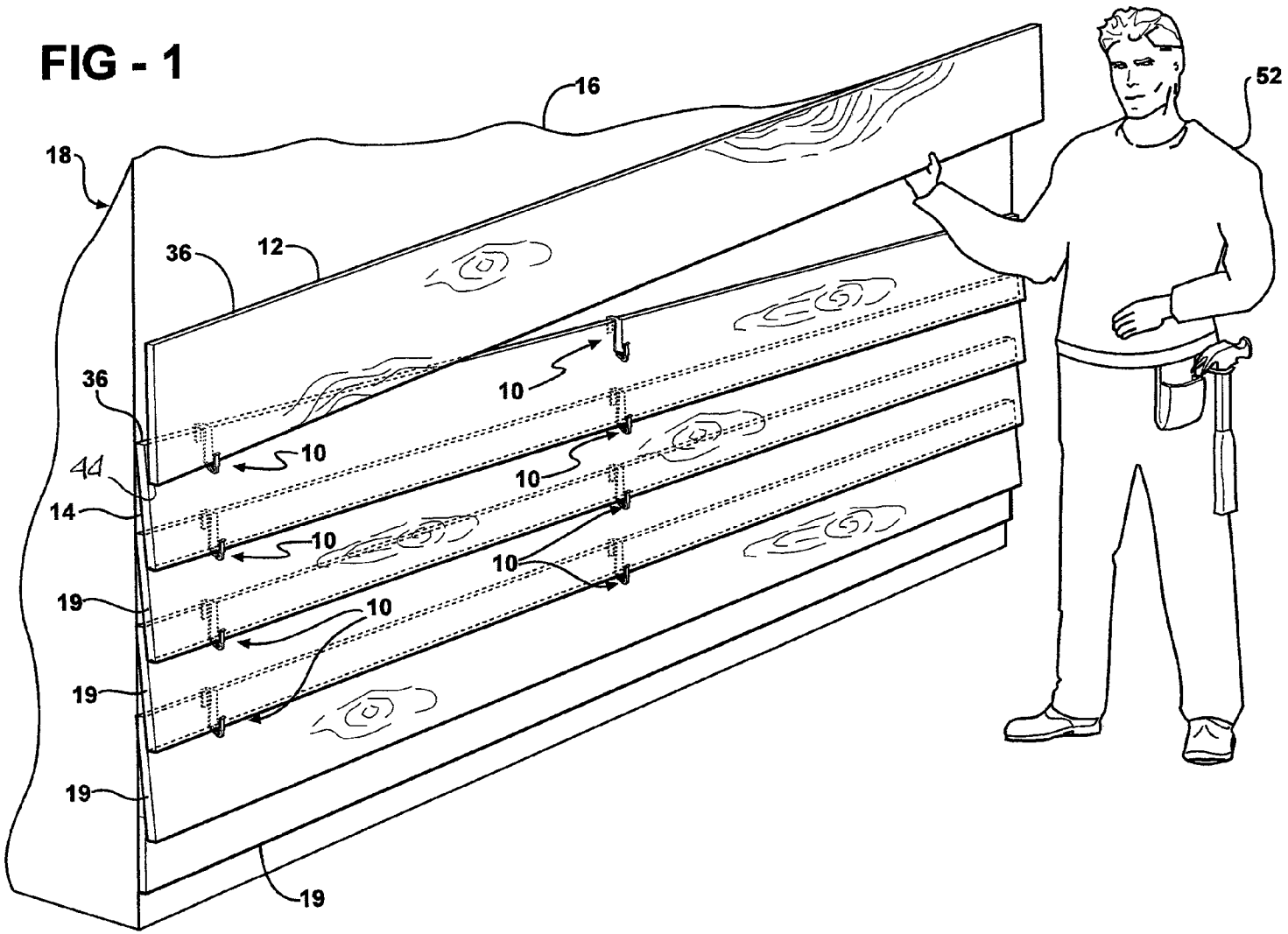
FIG. 1 is a perspective view of a siding installer using the invention when securing siding to a wall.
Figure 2:
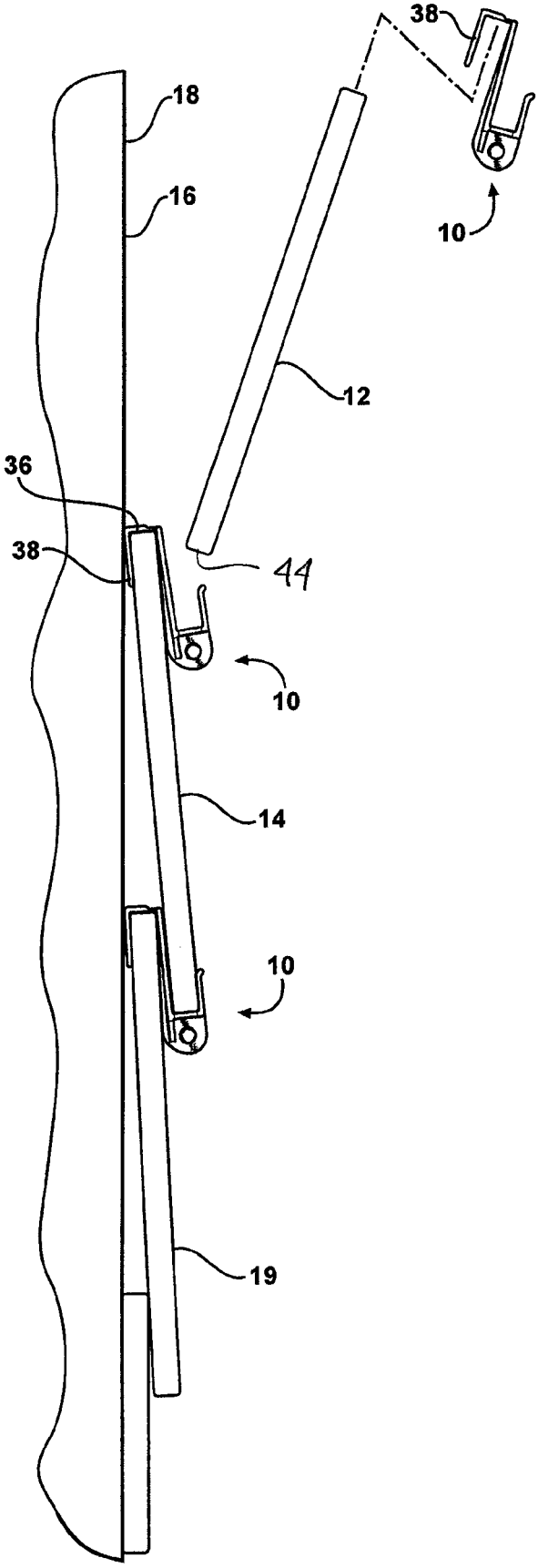
FIG. 2 is a side view of a wall, partially cut away, with siding being secured thereto with the use of the invention.

Referring to FIGS. 1 and 2, a mounting clip is generally indicated at 10. The mounting clip 10 is used to assist in the positioning and mounting of a first siding board 12 with respect to a second siding board 14. (The relationship of the first 12 and second 14 siding boards is a relative one. Once the first siding board 12 is secured, it becomes the second siding board against which another siding board will be secured relative thereto.) The first siding board 12 overlaps the second siding board 14 to cover a wall 16 of a building 18. The remaining siding board 19 have all been secured to the wall 16. In using the mounting clip 10, it is contemplated that the second siding board 14 is fixedly secured to the wall 16. The second siding board 14 at one time may have been the first siding board 12 with respect to the mounting clip 10 in that the mounting clips 10 were used to secure the second siding board 14 previously.

Figure 3:
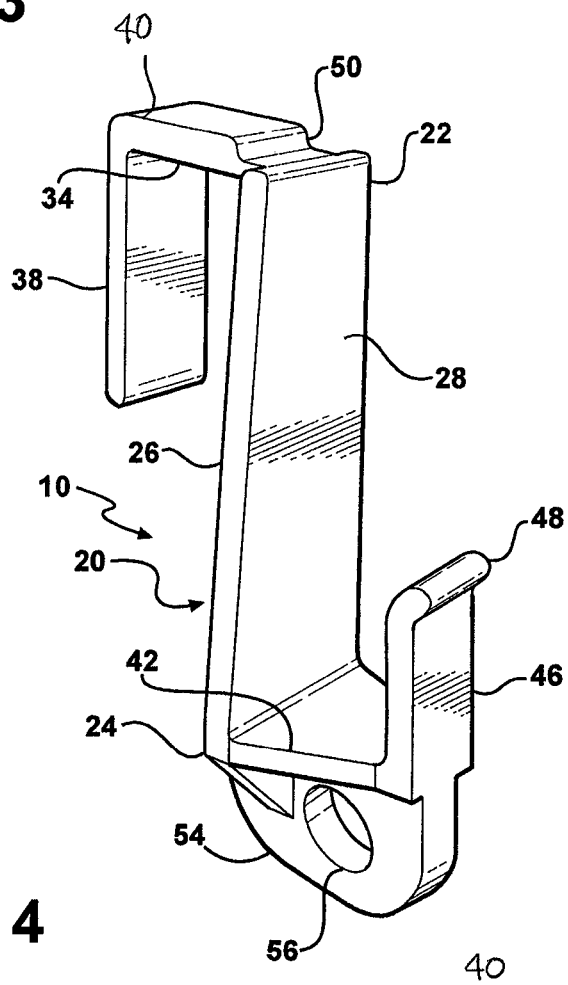
FIG. 3 is a perspective view of one embodiment of the invention.
Figure 4:
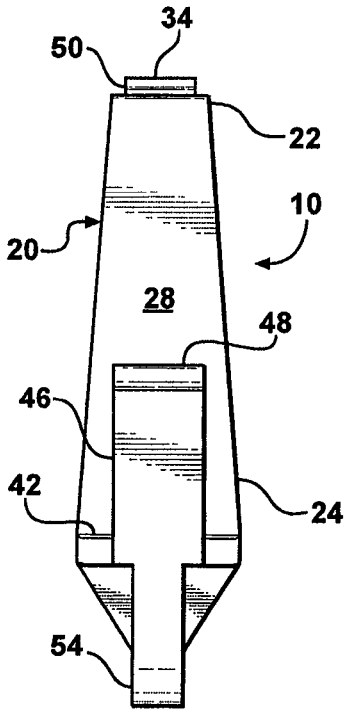
FIG. 4 is a front side view of the invention.
Figure 5:
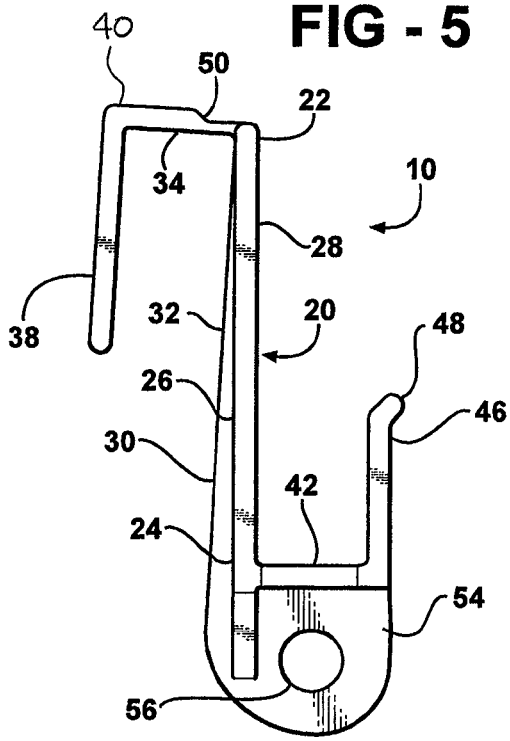
FIG. 5 is a side view of the invention.

Referring to FIGS. 3 through 5, the mounting clip 10 includes a base 20 that extends between the top end 22 and a bottom end 24. The base 20 defines an inboard surface 26 and an outboard surface 28, which are defined with respect to their relationship to the wall 16. The base 20 also includes a spacer 30 which extends out from the outboard surface 28 perpendicularly thereto. The spacer 30 angles the first siding board 12 with respect to the second siding board 14 due to an abutment surface 32 which extends through a plane that intersects the plane of the base 20.

The mounting clip 10 also includes a hanger 34. The hanger 34 is fixedly secured to the top end 22 of the base 20. The hanger 34 hangs the mounting clip 10 on the second siding board 14 and, in particular, a top surface 36 of the second siding board 14. The hanger 34 extends inwardly perpendicular to the base 20. The length of the hanger 34 is roughly the depth of the top surface 36 of the second siding board 14. The mounting clips 10 are designed to have dimensions similar to the siding boards 12, 14 that they are securing. It should be appreciated by those skilled in the art that variances in the dimensions of the mounting clip 10 to satisfy their compatibility with the different dimensions siding boards 12, 14 does not deviate from the concept disclosed herein. The mounting clip 10 also includes a securing tab 38 which is fixedly secured to the hanger 34. The securing tab 38 secures the mounting clip 10 to the second siding board 14. The securing tab 38 extends downwardly from an inner end 40 of the hanger 34, generally perpendicular thereto. Therefore, the securing tab 38 and the base 20 are generally parallel to each other. The securing tab 38 is shorter than the base 20.

Because the dimensions from one mounting clip 10 to another are identical, tolerances in the installation of siding boards 12, 14, 19 are much more precise than were previously attained using prior art methods. In addition, use of the mounting clips 10 greatly reduces the man hours to complete the installation.

The mounting clip 10 also includes a shelf 42. The shelf 42 is fixedly secured to the bottom end 24 of the base 20. The shelf 42 positions the first siding board 12 such that the portion of the first siding board 12 overlaps the second siding board 14. The shelf 42 is designed to receive a bottom surface 44 of the first siding board 12 thereon. Extending upwardly and outwardly from the shelf 42 is a holding tab 46. The holding tab 46 secures the first siding board 12 on the shelf 42. The holding tab 46 has a distal end 48 which is rounded such that it extends further outboard than the majority of the holding tab 46.

Returning attention to the hanger 34, the hanger includes a relief 50 which is disposed adjacent the top end 22 of the base 20. The relief 50 facilitates the removal of the base 20 from the hanger 34 after the first siding board 12 has been mounted to the wall 16. The relief 50 is designed to allow a user 52 to break the base 20 and shelf 42 off and away from the hanger 34, eliminating the requirement to remove the total mounting clip 10 after the first siding board is secured to the wall 16. This reduces time in siding the wall 16.

Figure 6B:
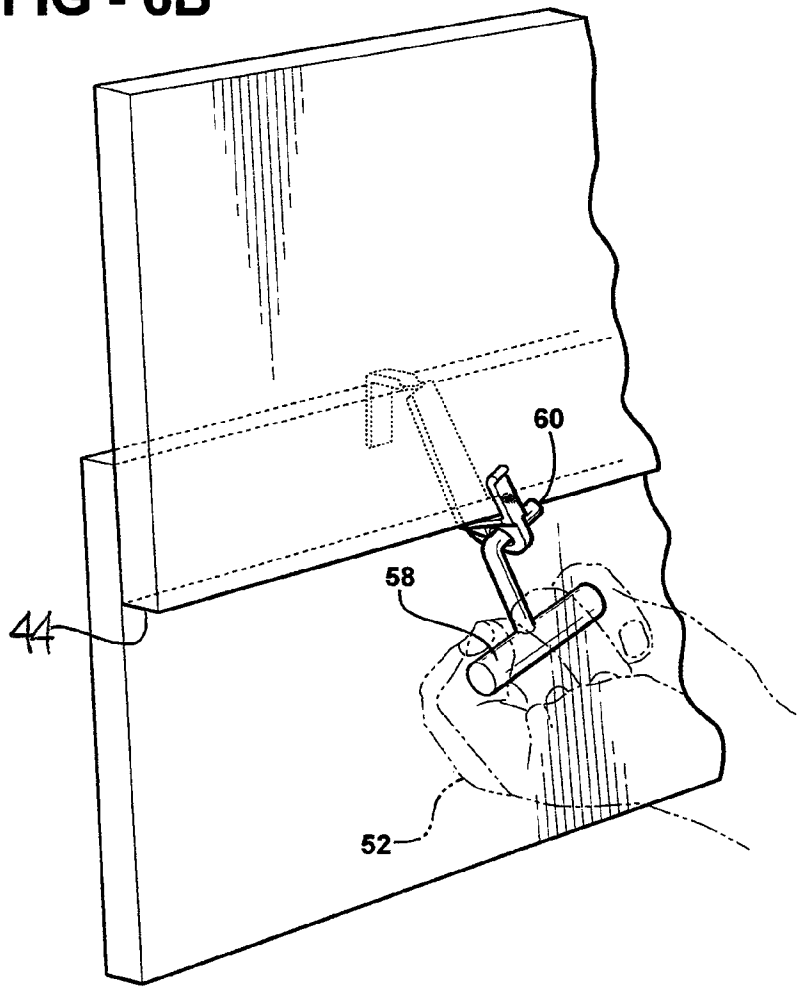
FIGS. 6A and 6B are perspective views of an operator removing the invention with tool after the siding has been secured to the wall.
Figure 6A:
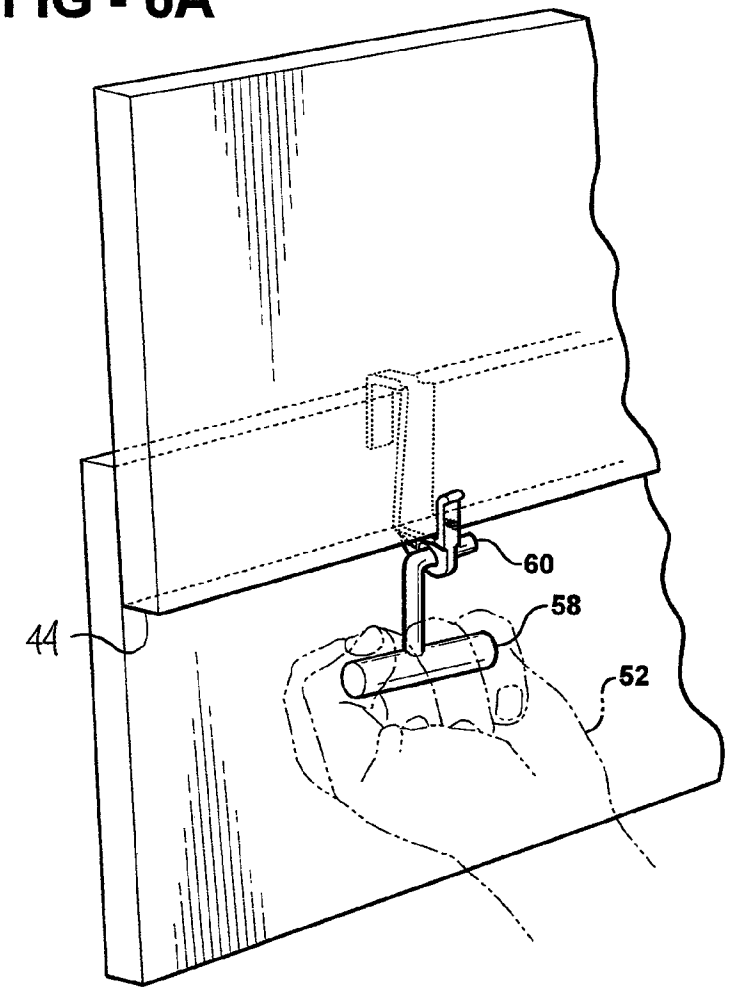

To aid the user 52 in the removal of the base 20 and shelf 42 from the mounting clip 10 after the first siding board 12 has been secured to the wall 16, a removal tab 54 is fixedly secured to the shelf 42. The removal tab 54 aids the removal of the base 20 and the shelf 42 when the first siding board 12 is secured to the wall 16. The removal tab 54 includes a hole 56 that extends through the removal tab 54. Referring to FIGS. 6A and 6B, hand tool 58 may be used wherein a tool tip 60 is inserted into the hole 56 allowing for the quick removal of the base 20 and the shelf 42 when the hand tool is twisted with the tool tip 60 inside the hole 56.

As may be seen in the Figures, the base 20, securing tab 38 and the holding tab 46 are all substantially parallel to each other. Likewise, the hanger 34 and the shelf 42 are substantially parallel to each other to generally form a Z-shaped mounting clip 10. It should be appreciated by those skilled in the art that these spatial relationships may vary depending on the type of siding used and the contour of the contour of the siding used to cover a wall. Because the mounting clip 10 is clearly visible during the mounting of the first siding board 12, the user 52 can quickly identify where to nail the second siding board 14 to the wall 16. More specifically, the base 20 of the mounting clip 10 clearly identifies a region of the second siding board 14 that will be covered by the first siding board 12.

An added advantage to the use of the mounting clip 10 in the covering of a wall 16 with siding 12, 14 is that the hanger 34 and securing tab 38 remain between the wall 16 and the siding boards 12, 14. By spacing the siding boards 12, 14 from the wall 16, an air gap exists allowing ventilation therealong which aids in the removal of moisture should any be present.

It is contemplated that the mounting clip 10 is manufactured from a plastic material. The material used to fabricate the material may be any hard material that would be able to withstand the support of holding the first siding board 12 with respect to the second siding board 14, while being easily torn into two pieces after the completion of mounting the first siding board to the wall 16.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

I claim:

1. A mounting clip for assisting in positioning and mounting a first siding board to a wall overlapping a portion of a second siding board, said mounting clip comprising:

a base extending between a top end and a bottom end;

a hanger fixedly secured to said top end of said base for hanging said mounting clip on the second siding board;

a shelf fixedly secured to said bottom end of said base for positioning the first siding board such that the portion of the first siding board overlaps the second siding board; and a removal tab fixedly secured to said shelf for aiding in the removal of said base and said shelf when the first siding board is secured to the wall, said removal tab defining a hole therethrough for receiving a tool to assist the removal of said base and said shelf.

2. A mounting clip as set forth in claim 1 wherein said removal tab extends down from said shelf perpendicularly thereto.

3. A mounting clip as set forth in claim 2 including a securing tab extending out from said hanger for securing the mounting clip to the second siding board.

4. A mounting clip as set forth in claim 3 wherein said hanger includes a relief disposed adjacent said base for facilitating removal of said base from said hanger after the first siding board is mounted to the wall.

5. A mounting clip as set forth in claim 4 including a spacer extending out of said base for angling the first siding board with respect to the second siding board.

6. A mounting clip as set forth in claim 5 including a holding tab fixedly secured to said shelf for holding the first siding board on said shelf.

7. A mounting clip as set forth in claim 6 wherein said holding tab extends out to a distal end.

8. A mounting clip as set forth in claim 7 wherein said distal end curves outwardly and away from said base.

9. A mounting clip as set forth in claim 7 wherein said base, said securing tab and said holding tab are substantially parallel to each other.

10. A mounting clip as set forth in claim 9 wherein said hanger and said shelf are parallel to each other.

11. A mounting clip as set forth in claim 10 wherein said shelf and said base are perpendicular to each other.

* * * * *